US005319300A

United States Patent [19]

Wood

[11] Patent Number: 5,319,300

[45] Date of Patent: Jun. 7, 1994

[54] ERROR COMPENSATING CIRCUIT FOR POWER CONSUMPTION METER

[76] Inventor: Sylvester Wood, 504 W. Main St., Weatherly, Pa. 18255

[21] Appl. No.: 64,901

[22] Filed: May 24, 1993

[51] Int. Cl.[5] ..... G05F 1/70

[52] U.S. Cl. ..... 323/207; 363/21; 307/44; 307/48; 324/142

[58] Field of Search ..... 363/16, 21; 323/207, 323/212, 215; 307/4, 5, 44, 46, 48, 49; 324/142

[56] References Cited

U.S. PATENT DOCUMENTS 4,066,960 1/1978 Milkovic ..... 324/142

4,206,367 6/1980 Petruska et al. .

4,217,546 8/1980 Milkovic ..... 324/142

4,535,287 8/1985 Milkovic ..... 324/142

*Primary Examiner*—Emanuel T. Voeltz

*Attorney, Agent, or Firm*—Arthur R. Eglington

[57] ABSTRACT

An electrical power consumption error correction circuit for use with 220 volt ac power meters, or with 220 volt ac power supplies, of the type designed to reduce inaccurate energy use measurements by yielding a more accurate residential/commercial power consumption measurement by a 220 volt ac power meter through the use of at least one measurement correction circuits.

4 Claims, 2 Drawing Sheets

ERROR COMPENSATING CIRCUIT FOR POWER CONSUMPTION METER

FIELD OF THE INVENTION

This invention relates to alternating current electric power delivery in general, and in particular, to alternating current power metering connected to a power source for measuring power consumption of electrical systems.

BACKGROUND OF THE INVENTION

Reducing the power loss in electric loads has been a focus of much development for some time. While early work focused on power transmission losses, more recent developments have also addressed power losses in 220 volt and 110 volt residential and commercial site load networks. Power efficiency meters connected between a utility metering device and a residential or commercial load have measured the power loss or efficiency of such a site load network.

It has been found that power loss can be reduced by altering the sinusoidal shape of the 60 cycle voltage supplied by a utility company. The object of such previous work was to reduce the transition time of the voltage from half peak value to half peak value. This has been done with 110 volt or 220 volt power supplies connected between a utility metering device and an electrical load.

A power supply having an internal dc battery is disclosed in U.S. Pat. No. 3,319,074, wherein an external ac source is rectified and applied to a load under control of a transistor. The dc battery compensates for any fluctuations of the ac power source and is maintained in a fully charged condition. The operation of this power supply, while designed to maintain a constant voltage on the load, introduces additional power losses and does not cope with the varying demands of ac loads, insofar as efficient supply of energy is concerned.

U.S. Pat. No. 4,206,367 (Petruska, et al.), shows a 220 volt power supply having an internal dc battery and a charge/discharge circuit. This device operates to reduce the power drawn from the utility company supplied external ac source while servicing the residential load.

Use of the power supply shown in U.S. Pat. No. 4,206,367, in cooperation with electrical loads, has resulted in the increased use of power consumption metering of the power supplied by public utilities to their customers. These power use meters presently are unable to accurately measure energy savings actually being attained.

A residential use or power consumption meter is connected directly to the utility power metering device and uses the 220 volt power supplied at that point to calculate and record (by magnetic rotating dial and hand pointers) the power consumption of the customer. Residential use, while sometimes at 220 volts; e.g. electric ranges and clothes dryers, is primarily delivered at 110 volts. This is accomplished by splitting the three-wire 220 volt supply line into two, two-wire 110 volt subcircuits in the residential distribution box; i.e., the circuit breaker box.

The power supply of the Petruska patent is a 220 volt device which is intended to be connected between the utility power metering device and the residential circuit breaker box. The power consumption meter is a 220 volt device which is intended to be connected between the utility power metering device and the power supply of the Petruska patent. Because the power consumption meter measures 220 volt current usage across the load to calculate residential power consumption at both 220 volts and 110 volts, an error in calculating the true power consumption can occur.

An object of the present invention is to provide an electrical power consumption error correction circuit means for a 220 volt ac power consumption meter.

A further object of the present invention is to incorporate such an electrical power consumption error correction circuit means into a residential power supply of the type shown in U.S. Pat. No. 4,206,367.

An additional object of the present invention to provide a residential power supply with an electrical power consumption error correction circuit means which reduces 220 volt drawdown from the utility company ac voltage supply during 110 volt load usage.

SUMMARY OF THE INVENTION

The electrical power consumption error correction circuit of the present invention is intended to be connected in each 110 volt leg of a 220 volt ac supply line. The error correction circuit means includes a pair of storage capacitors straddling another storage capacitor or rechargeable battery. Switching transistors apply the instantaneous voltage level of the sinusoidal ac supply voltage to, and control the charging and discharging of, the voltage storage elements of the error correction circuit means resulting in an applied negative current flow to correct for the inaccurate power consumption measurement of 220 volt ac metering devices attached across an electrical load.

The present invention comprises the combination of an ac source of voltage, an electrical power metering means, and an associated electrical load having a power supply circuit for feeding current to said load. The power supply circuit consists of a dc battery having terminals of opposite polarity, coupling means for conducting current from the ac voltage source through said load, rectifier means for conducting said current in one direction through the load, switch means for conducting current from the battery through the load in the opposing direction, and control means for the switch means for conducting battery current in an out-of-phase relation to the current conducted in said one direction by the rectifier means with an improved electrical power consumption error correction circuit means.

At least one error correction circuit means is intended to be incorporated into the recited combination with the error correction circuit means having a variable voltage source for applying a predetermined voltage to a transformer means with said transformer means providing the desired error compensation voltage to the at least one error correction circuit means for creating a negative current flow back to the power metering means resulting in a reduction of metered electrical power such that the electrical power metering means measures power usage in direct proportion to the actual electrical load. The voltage applied through said variable voltage source is determinative of the extent of the power metering error correction.

It is also intended with the present invention to combine paired error correction circuits, one in each leg of the power supply circuit, for accomplishing the same end; a reduction of metered electrical power such that the electrical power metering means measures power usage in direct proportion to the actual electrical load.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE DRAWINGS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
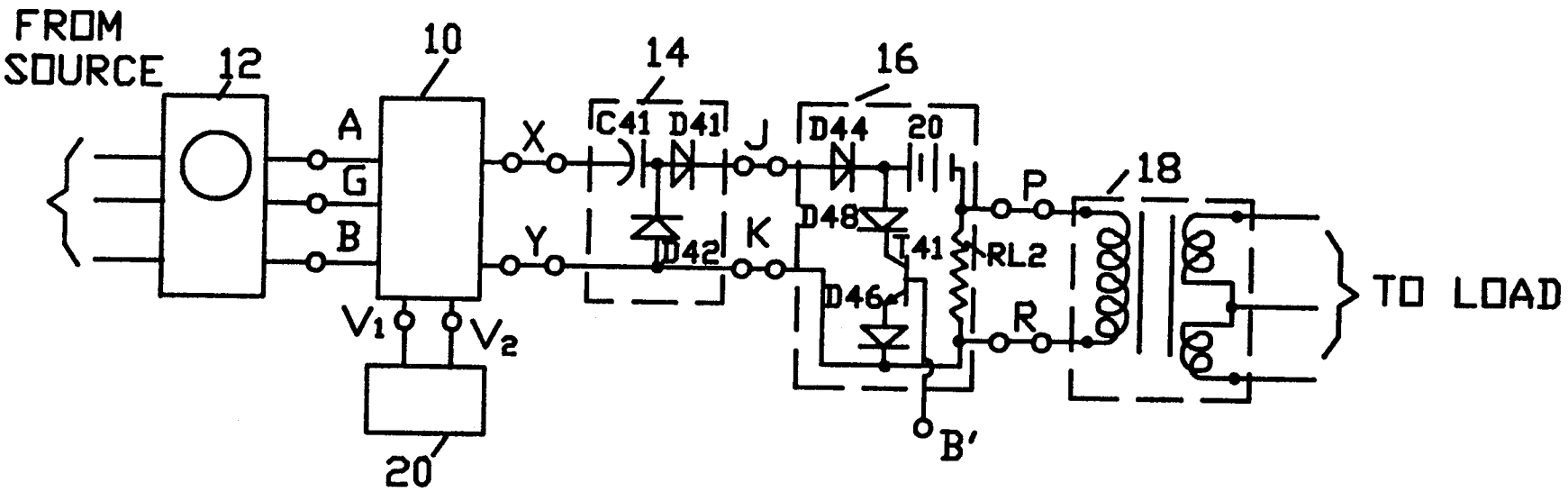
FIG. 1 is a representative block diagram of the electrical power delivery circuit to a residence or commercial establishment including the error correction circuit of the present invention.

Referring now to the drawings in detail, where like numerals refer to like parts or elements, there is shown in FIG. 1 the present invention of the paired error correction circuits, which is identified, generally, as 10. The paired error correction circuits 10 are interposed between the utility power metering device 12 and the residential or commercial circuit breaker box (i.e. the load), not shown. Several other circuit elements are shown in FIG. 1. These are a voltage doubling means 14, a phase controller means 16, and a transformer means 18. Also shown is a voltage source 20 for supplying voltage to certain elements of the error correction circuits at the appropriate times. All of the foregoing will be described in greater detail hereinafter.

Figure 2:
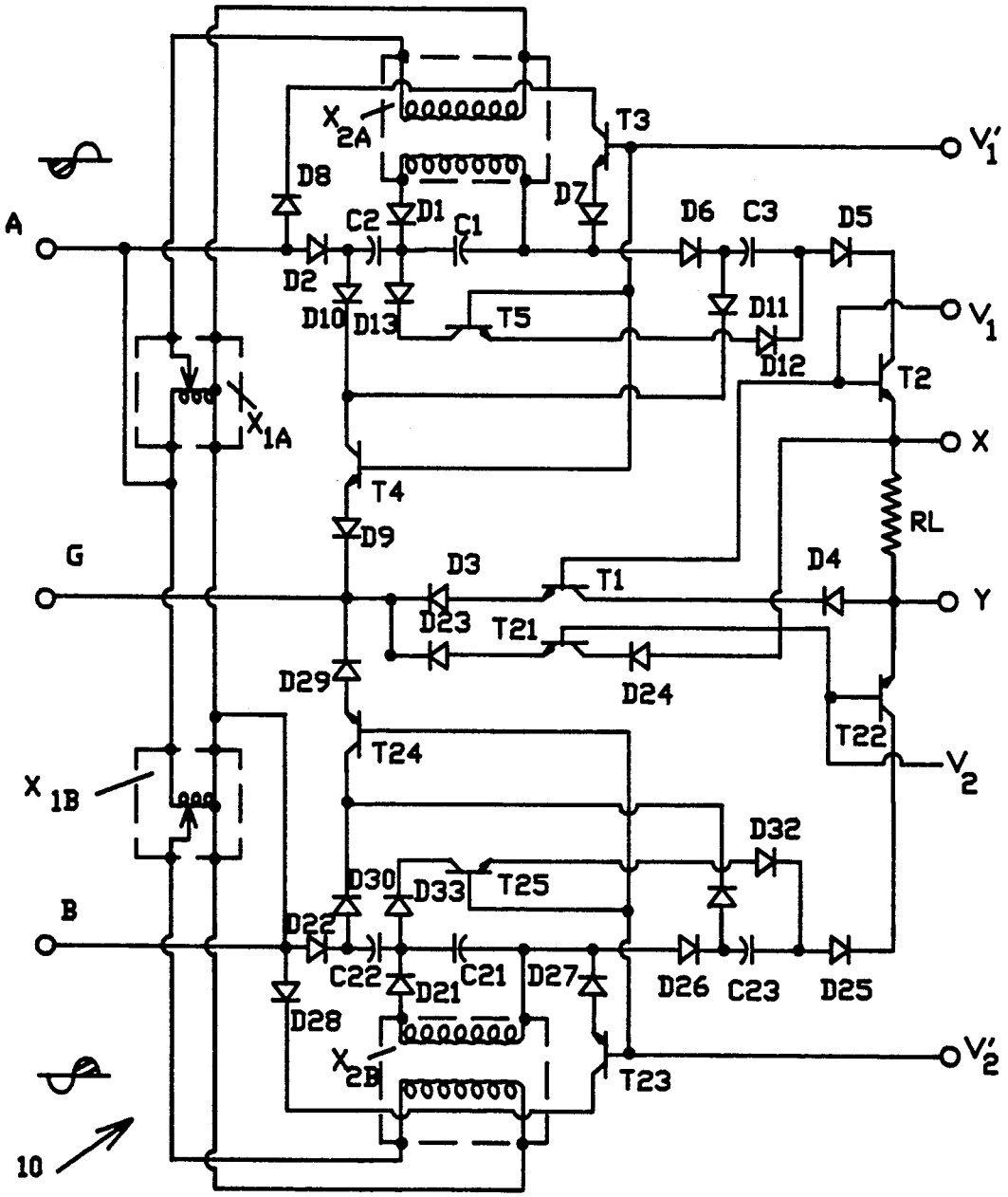
FIG. 2 is a schematic diagram of the paired error correction circuits of the present invention.

With reference to FIG. 2, the paired error correction circuits 10 can be described as follows. The external power source delivered by the utility company is delivered to most residential and commercial properties in a 3-wire system carrying 240 volts ac across the two legs A, B, with the third leg being neutral. Such wire delivery system usually comes from a step-down transformer connected to the utility company power distribution net. At the entrance to the property receiving the power delivery the utility company terminates its lines in a power metering device such as the meter box 12 of FIG. 1. Exiting the meter box 12 on the private property side of the box is a 3-wire system delivering 240 volts ac on two of its legs with the third leg being ground. One of each of the paired error correction circuits 10 of the present invention is connected to each of the legs A, B of the residential/commercial wire delivery system entering the property. The reader is to understand that the error compensating circuit in the upper half of FIG. 2 is substantially identical to the error compensating circuit in the lower half of FIG. 2; the dividing line being along the line substantially connecting G to Y.

In description of the "A side" of the error correcting circuit means 10 of the present invention, an adjustable transformer $X_{1A}$ is employed to reduce the 120 volts ac input across leg A to G and to apply 40 volts ac across the primary coil of transformer $X_{2A}$. The remaining circuit elements of the A side error correction circuit are all indicated by standard symbols and are used to rectify the external ac current to charge a dc power source with the rectified current conducted through said power source during one-half phase of each cycle of the alternating current source. During the other half phase cycle, the alternating current flows through the load by discharge from the dc power source through a transistor that is switched to its conducting state by an appropriate signal voltage connected to the alternating current source.

Before describing the detailed circuit elements, their interconnection, and cooperative operation, it is important to note that the voltage source 20 is adapted to deliver voltages during each half cycle of the alternating current. For the A side of the error correcting circuit means, the voltage source 20 delivers $V_1$ at 12 volts dc during the positive half cycle and $V_1'$ at 12 volts dc during the negative half of the cycle. Likewise, the voltage source 20 delivers $V_2$ and $V_2'$ at 12 volts dc during the positive and negative half cycles, respectively, of the current in the B side of the error correcting circuit means. The respective signal voltage lines $V_1$, $V_1'$, $V_2$ and $V_2'$ indicate the connection of the bases of the respective transistors to a 12 volt dc signal source, and are to be considered to be a schematic representation of separate, isolated signal voltage sources for each of the respective transistors although shown to be in a "series" relationship in the drawing. The isolated voltage sources for the respective transistors may be separate tabs from a step-down transformer contained within the voltage source 20 or corresponding transformers providing the required output voltage to each of the respective transistors.

The secondary coil or winding of transformer $X_{2A}$ provides 40 volts ac to the A side error correction circuit means. Passing this voltage through diode D1 causes capacitor C1 to charge to approximately 57 volts dc. It is assumed that capacitors C2 and C3 are charged to approximately half the dc voltage charge of capacitor C1, i.e. approximately 28 volts dc. During the positive half cycle of the A leg of the power distribution circuit current will flow out of capacitor C2 through diode D2 and out of the error correction circuit through connector A, back through the power company transformer winding, and return through the ground connector G and through diode D3. The current will continue through transistor T1, which has been switched on by signal voltage $V_1$, and flow through diode D4 and resistive load $R_L$, approximately a 155 ohm resistor. The current will continue through transistor T2 (which has been switched on by signal voltage $V_1$) and continue through diode D5 to charge capacitor C1 with approximately one amp. The current flow goes through capacitor C3 and diode D6 delivering the one amp current to capacitor C1 charging that capacitor to the recited voltage level. To increase the charge across capacitor C1 to two amps, an additional amp flows into the capacitor from the secondary winding of transformer $X_{2A}$ and into capacitor C1 so that a two amp charge exists during the positive half cycle. Hence, a usage of two amps for the error correction circuit means has occurred up to this time.

During the negative half cycle of the A leg, transistors T1 and T2 are turned off and transistors T3, T4 and T5 are turned on by signal voltage $V_1'$. Beginning with capacitor C1, current flows out of C1 through diode D7, through transistor T3 and diode D8 to exit the error correction circuit means through A, continuing through the power distribution transformer and coming back to the error correction circuit at G. The current would then flow through diode D9 and transistor T4, and through diode D10 to charge capacitor C2 to one amp. At the same time the current would flow through diode D11 to charge capacitor C3 to one amp. In order to get capacitor C3 to charge, a connection must be made between the positive plates of capacitor C1 and C3 through diode D12, transistor T5 and diode D13. This places the charge of the capacitors C1, C2 and C3 back to their original values and creates a negative current flow of two amps back to the power metering device 12.

A similarly functioning error correction circuit to the "A side" of the error correcting circuit means 10 is the "B side" of the error correcting circuit means. Again referring to FIG. 2, an adjustable transformer $X_{1B}$ is employed to reduce the 120 volt ac input across leg B to G and to apply 40 volts ac across the primary coil of transformer $X_{2B}$. As in the case of the previously described "A side" of the error correction circuit means, the other circuit elements of the "B side" are indicated by standard symbols. The same voltage source 20 delivers $V_2$ and $V_2'$ at a nominal 12 volts dc during the positive and negative half cycles, respectively, of the current in the B side of the error correcting circuit means as discussed above.

The secondary coil or winding of transformer $X_{2B}$ provides 40 volts ac to the B side error correction circuit means. Passing this voltage through diode D21 causes capacitor C21 to charge to approximately 57 volts dc. As in the case of the A side error correction circuit means, it is assumed that capacitors C22 and C23 are charged to approximately half the dc voltage charge of capacitor C21, i.e. approximately 28 volts dc. During the positive half cycle of the B leg of the power distribution circuit, current will flow out of capacitor C22 and out of the error correction circuit through connector B, back through the power company transformer winding, and return through the ground connector G and through diode D23. The current will continue through transistor T21, which has been switched on by signal voltage $V_2$, and flow through diode D24 and resistive load $R_L$, approximately a 155 ohm resistance. The current will continue through transistor T22 (which has been switched on by signal voltage $V_2$), and continue through diode D25 to charge capacitor C21 with approximately 1 amp. The current flow goes through capacitor C23 and diode D26 delivering the 1 amp current to capacitor C21, charging that capacitor to the recited voltage level. To increase the charge across capacitor C21 to 2 amps, an additional amp flows into the capacitor from the secondary winding of transformer $X_{2B}$ and into capacitor C21 so that a 2 amp charge exists during the positive half cycle. Hence, the usage of 2 amps for the error correction circuit means has occurred up to this time.

During the negative half cycle of the B leg, transistors T21 and T22 are turned off and transistors T23, T24 and T25 are turned on by signal voltage $V_2'$. Beginning with capacitor C21, current flows out of C21 through diode D27, through transistor T23 and diode D28 to exit the error correction circuit means through B, continuing through the power distribution transformer then coming back to the error correction circuit at G. The current would then flow through diode D29 and transistor T24, and through diode D30 to charge capacitor C22 to 1 amp. At the same time the current would flow through diode D31 to charge capacitor C23 to 1 amp. In order to get capacitor C23 to charge, a connection must be made between the positive plates of capacitor C21 and C23 through diode D32, transistor T25 and diode D33. This places the charge of the capacitors C21, C22 and C23 back to their original values and creates a negative current flow of 2 amps back to the power metering device 12.

The resistive load, $R_L$, is connected across connectors X and Y with the voltage potential across these two connectors at approximately 155 volts ac. The current flows from the error correction circuit means 10 through connectors X and Y and enters a voltage doubler 14. The voltage doubler is a standard circuit, well known in the art, made from appropriately coupled diodes D41 and D42 and a capacitor C41, as shown in FIG. 1. The output of the voltage doubler 14, across connectors J and K, is a half-wave voltage in the approximate range of 220 volts ac.

The electrical power coming into the residence or commercial business is then passed through a phase controller 16 which was generally described as the automatic power by-pass control circuit 36 in U.S. Pat. No. 4,206,367, which general description is incorporated herein by reference. In further description, the half-wave rectified voltage of approximately 220 volt ac across connectors J and K is applied to the anode of diode D44 for conducting current alternately through dc battery 20. The battery 20 has its positive terminal connected to the cathode of diode D44 and its negative terminal connected to one end of a second resistive load, $R_{L2}$. Current will be conducted through diode D44 during the positive half cycle of the alternating current cycle of the power applied to input legs A and B after the voltage applied to the phase controller exceeds the voltage of battery 20. When the voltage exceeds the potential of the battery 20, the current will be conducted through the battery 20 to the resistive load $R_{L2}$. During the negative half cycle of the A leg (or the positive half cycle of the B leg) transistor T41 is energized so that current will flow through battery 20 when the previously described conditions of the applied voltage exceeding the battery voltage occur. The current will flow through diodes D46, through the transistor T41 and the diode D48, but only when T41 is switched on by applying a signal voltage through connector B'. An SCR (silicon controlled rectifier) may be substituted for transistor T41 with the state of this SCR [T41] controlled by signal voltage applied at B'. Thus, the phase controller 16 creates a current flow across the resistive load $R_{L2}$ (155 ohms) in successive half-cycles of the A and B legs of the incoming power line. The resulting voltage potential across connectors P and R is 110 volts ac, nominally, assuming the suggested current flow of the error correction circuit. The operation of the phase controller 16 is similar to the switched out-of-phase relation to the conductive periods of the paired diodes of the automatic power by-pass control circuit 36 of U.S. Pat. No. 4,206,367. Reference can be had to said patent for description of similarly functioning circuit elements, but this description is to be considered controlling with regard to the functioning of the elements of the present invention.

Load transformer 18 has its primary winding connected across connectors P and R such that a nominal 110 volt ac voltage is applied across the terminals of its primary winding. The transformer 18 is configured such that the dual secondary windings have a common terminus to ground with the opposite terminals applying 110 volts ac to each leg of the commercial or residential load, usually through a circuit breaker or fuse box.

The voltage supplied by the power company and applied across the input legs A and B typically varies sinusoidally for each cycle of the alternating current. The rectified current is conducted through diode D44 and the diode/transistor circuit containing diodes D44 and D46 and transistor T41, respectively, during the positive and negative halves of the complete alternating cycle. The rectified currents, however, are blocked during a portion of each half cycle by the opposing operating potential of battery 20 which is less than the peak voltage of the ac power supply or source. It is the battery generated current which is conducted through the resistive load $R_{L2}$ during the non-conductive periods of the diodes D44, D46 and D48, respectively. These currents which are applied across the resistive load $R_{L2}$ are mixed to produce an abnormal resultant sinusoidal current. These various wave shapes are similar to those set forth in FIG. 3 of U.S. Pat. No. 4,206,367, which disclosure is incorporated herein by reference.

The battery 20, when conducting the rectified current to the resistive load, is recharged so that it is maintained in a fully charged condition despite the current drain which occurs each cycle during the non-conductive periods of the previously noted diodes. Therefore, the battery acts as a current collecting device and not as an independent power source. The transistor T41 acts merely as a control of the period when the battery 20 will conduct current when the B side error correction circuit means is in use.

The power drain during the "off phase" for each of the 110 volt legs of the ac power supply circuit, as measured across the load, is greatly reduced. Therefore, use of the electrical power consumption error correction circuit means of the present invention will yield a more accurate residential/commercial power consumption measurement by a 220 volt electrical power consumption meter.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

I claim:

1. In combination with an ac source of voltage, an electrical power metering means, and an associated electrical load having power supply circuit for feeding current to said load which consists of a dc battery having terminals of opposite polarity, coupling means for conducting current from the ac source through said load, rectifier means for conducting said current in one direction through the load, switch means for conducting current from the battery through the load in the opposing direction, and control means for the switch means for conducting battery current in an out-of-phase relation to the current conducted in said one direction by the rectifier means, the improvement comprising at least one error correction circuit means having a variable voltage source for applying a predetermined voltage to a transformer means, said transformer means providing the desired error compensation voltage to the at least one error correction circuit means for creating a negative current flow back to the power metering means resulting in a reduction of metered electrical power such that the electrical power metering means measures power usage in direct proportion to the actual electrical load.

2. The combined apparatus of claim 1 wherein the voltage applied through said variable voltage source is determinative of the extent of the power metering error correction.

3. In combination with an ac source of voltage, an electrical power metering means, and an associated electrical load having power supply circuit for feeding current to said load which consists of a dc battery having terminals of opposite polarity, coupling means for conducting current from the ac source through said load, rectifier means for conducting said current in one direction through the load, switch means for conducting current from the battery through the load in the opposing direction, and control means for the switch means for conducting battery current in an out-of-phase relation to the current conducted in said one direction by the rectifier means, the improvement comprising paired correction circuit means having a variable voltage source for applying a predetermined voltage to a transformer means, said transformer means providing the desired error compensation voltage to both of the error correction circuit means at mutually exclusive alternating time periods for creating a negative current flow back to the power metering means resulting in a reduction of metered electrical power such that the electrical power metering means measures power usage in direct proportion to the actual electrical load.

4. The combined apparatus of claim 3 wherein the voltage applied through said variable voltage source is determinative of the extent of the power metering error correction.

* * * * *